US008459462B2

(12) United States Patent
Lavi et al.

(10) Patent No.: US 8,459,462 B2
(45) Date of Patent: Jun. 11, 2013

(54) SYSTEM AND METHOD FOR SORTING SPECIMEN

(75) Inventors: Leroy Sina Lavi, Laguna Niguel, CA (US); Erwin Nicolaas Marinus Petrus Ruijs, Laguna Niguel, CA (US)

(73) Assignee: Quest Diagnostics Investments Incorporated, Wilmington, DE (US)

( * ) Notice: Subject to any disclaimer, the term of this patent is extended or adjusted under 35 U.S.C. 154(b) by 763 days.

(21) Appl. No.: 12/249,819

(22) Filed: Oct. 10, 2008

(65) Prior Publication Data

US 2010/0089803 A1 Apr. 15, 2010

(51) Int. Cl.
*B07C 5/02* (2006.01)

(52) U.S. Cl.
USPC ..... 209/3.3; 209/522; 209/523; 209/546; 209/583

(58) Field of Classification Search
USPC ..... 209/3.3, 522, 523, 546, 583; 422/62, 422/63, 65, 68.1; 73/863.01, 864.91; 436/43, 436/47
See application file for complete search history.

(56) References Cited

U.S. PATENT DOCUMENTS

| | | | | |
|---|---|---|---|---|
| 4,513,522 | A | 4/1985 | Selenke | |
| 4,588,880 | A | 5/1986 | Hesser | |
| 4,974,166 | A | 11/1990 | Maney et al. | |
| 5,097,421 | A | 3/1992 | Maney et al. | |
| 5,150,795 | A * | 9/1992 | Nakayama et al. | 209/3.3 |
| 5,333,715 | A | 8/1994 | Sapp | |
| 5,414,974 | A | 5/1995 | Van de Ven et al. | |
| 5,508,499 | A * | 4/1996 | Ferrario | 235/375 |
| 5,785,181 | A | 7/1998 | Quartararo, Jr. | |
| 6,141,602 | A * | 10/2000 | Igarashi et al. | 700/226 |
| 6,255,614 | B1 * | 7/2001 | Yamakawa et al. | 209/587 |
| 6,329,139 | B1 * | 12/2001 | Nova et al. | 506/30 |
| 6,377,203 | B1 | 4/2002 | Doany | |
| 6,598,796 | B2 * | 7/2003 | Harrop | 235/462.01 |
| 6,738,689 | B2 | 5/2004 | Sansone | |
| 6,959,229 | B2 | 10/2005 | Eidemiller | |
| 6,967,579 | B1 | 11/2005 | Elizondo | |
| 6,984,527 | B2 * | 1/2006 | Miller | 436/180 |
| 7,070,053 | B1 * | 7/2006 | Abrams et al. | 206/459.5 |
| 7,118,034 | B2 | 10/2006 | Baldassari et al. | |
| 7,218,231 | B2 | 5/2007 | Higham | |

(Continued)

FOREIGN PATENT DOCUMENTS

| | | |
|---|---|---|
| WO | WO 2006/110484 | 10/2006 |
| WO | WO 2008/052040 | 5/2008 |

OTHER PUBLICATIONS

1 International Search Report for PCT Patent Application No. PCT/US2009/0600063.

(Continued)

*Primary Examiner* — Terrell Matthews
(74) *Attorney, Agent, or Firm* — Foley & Lardner LLP

(57) ABSTRACT

Methods and apparatuses for efficient sorting of specimen include specimen containers, such as vials, positioned in container carriers, such as pucks. The specimen containers contain a specimen that is to be processed through, for example, one or more tests. The specimen containers contain an identifier for the specimen and the container carriers include an identifier, such as a radio frequency identification (RFID) tag. The identifier of the specimen is associated with the identifier of the container carrier. The container carriers with the specimen containers are then sorted based on the identifier of the container carrier according to the desired processing of the specimen containers.

25 Claims, 4 Drawing Sheets

U.S. PATENT DOCUMENTS

| | | | | |
|---|---|---|---|---|
| 7,227,469 | B2 | 6/2007 | Varner et al. | |
| 7,243,777 | B2 | 7/2007 | Reznik et al. | |
| 7,278,328 | B2 * | 10/2007 | Massaro | 73/863.01 |
| 7,308,114 | B2 | 12/2007 | Takehara et al. | |
| 7,364,907 | B2 * | 4/2008 | Weselak et al. | 436/43 |
| 7,416,134 | B2 | 8/2008 | McDonald | |
| 7,423,531 | B2 | 9/2008 | Bui et al. | |
| 7,487,061 | B2 * | 2/2009 | Biwa | 702/127 |
| 2004/0049314 | A1 | 3/2004 | Sansone | |
| 2005/0250211 | A1 | 11/2005 | Reinhardt et al. | |
| 2006/0134580 | A1 | 6/2006 | Raby et al. | |
| 2006/0213964 | A1 | 9/2006 | Excoffier et al. | |
| 2008/0198014 | A1 | 8/2008 | Vogt et al. | |

OTHER PUBLICATIONS

Supplementary European Search Report for European Patent Application No. 09819882.3 dated May 4, 2012.

* cited by examiner

SYSTEM AND METHOD FOR SORTING SPECIMEN

FIELD OF THE INVENTION

The present invention relates generally to the sorting of specimens, such as medical or other health-related specimens. More particularly, the present invention relates to automated sorting of specimens.

BACKGROUND OF THE INVENTION

The following description is provided to assist the understanding of the reader. None of the information provided or references cited is admitted to be prior art to the present invention.

Specimens taken at hospitals, clinics or other medical facilities are often sent to a remote facility for examination. Such facilities may be able to perform hundreds or thousands of different tests on such specimens. Thus, such facilities may receive numerous specimens on a daily basis, each such specimen needing to be directed to a specific lab and/or a specific test location.

SUMMARY OF THE INVENTION

The present invention provides methods and apparatuses for efficient sorting of specimen. In accordance with embodiments of the present invention, specimen containers, such as vials, are positioned in container carriers, such as pucks. The specimen containers contain a specimen that is to be processed through, for example, one or more tests. The container carriers include an identifier, such as a radio frequency identification (RFID) tag. The container carriers with the specimen containers are then sorted based on the identifier of the container carrier according to the desired processing of the specimen containers.

In one aspect, the invention relates to a method comprising binding an identity of a specimen container to an identity of a container carrier carrying the specimen container; conveying the container carrier with the specimen container along a path; detecting a position of the container carrier on the path; and sorting the specimen container based on the detection of the container carrier using the bound identities.

As used to herein, "binding" refers to linking or otherwise associating two components with each other. In a preferred embodiment, "binding" refers to electronically associating the two components and retaining the association in a device or system. Thus, "binding" may refer to associating the identity of one component with the identity of a second component. "Binding" may refer to associating two or more components with each other in a computer component such as a memory device (e.g., RAM, ROM, Flash memory, or other temporary or permanent memory device) and/or in an electronic table, spreadsheet or database, such as a relational database.

As used to herein, "identity" may refer to uniqueness of a component. In this regard, "identity" of a component distinguishes it from other components.

As used herein, "specimen container" refers to any container capable of holding a specimen therein. In various embodiments, a specimen container may include a vial, a test tube or other such container.

As used herein, "container carrier" refers to any device capable of holding, securing or containing a specimen container. A "container carrier" may be capable of physically supporting a specimen container. A "container carrier" may be capable of supporting a specimen container for transport of the container carrier and the specimen container.

As used herein, "conveying" refers to transporting by any of a variety of methods. For example, "conveying" may refer to transporting via a track using gravity, motor-driven rollers, or a conveyor belt. "Conveying" may include one or more methods of conveying.

As used herein, "detecting" may refer to determining the presence or a location of an object. "Detecting" may also refer to identifying a particular object as distinguished from other objects on a path.

As used herein, "sorting" refers to assigning, allocating, separating or grouping items according to one or more characteristics. For example, "sorting" may include separating specimen containers according to a temperature zone required for preservation of the specimens therein. Further, as an example, "sorting" may include grouping specimen containers according to a particular lab or test to which the specimen containers must be directed.

In one embodiment, the binding electronically matches the identity of the specimen container and the identity of the container carrier As used herein, "electronically matching" may refer to associating two or more components with each other in a computer component such as a memory device (e.g., RAM, ROM, Flash memory, or other temporary or permanent memory device) and/or in an electronic table or database, such as a relational database. "Electronically matching" may refer to binding, associating or otherwise linking, but does not necessarily require identities to be identical.

In one embodiment, a plurality of specimen containers are conveyed and sorted, and an identity of each container carrier is bound to an identity of an individual specimen container.

In one embodiment, the specimen container includes a specimen therein for processing.

As used herein, "specimen" refers to any biological or chemical entity requiring examination or testing. For example, "specimen" may include a biological fluid, such as blood or urine, or a biological tissue sample. A preferred biological sample is obtained or derived from a human.

As used herein, "processing" may refer to performing one or more tests on the specimen.

In one embodiment, the binding comprises associating an identifier of the specimen (applied to the specimen container) with an identifier of the container carrier in a computer system. The identifier of the specimen may include a bar code affixed to the specimen container. The identifier of the container carrier may include any identification system, preferably one that can be remotely sensed. A preferred container carrier identifier is a radio frequency identification (RFID) tag. The RFID tag may be embedded within a body of the container carrier. The detecting a position of the container carrier may include detecting the RFID tag of the container carrier by an RFID reader.

As used herein, "associating" may refer to relating, linking or otherwise connecting two or more items, such as in an electronic database or other electronic system.

As used herein, an "identifier" may refer to any feature which allows identification of an object, either unique identification or group identification, such as a bar code or a 2-D barcode, for example.

As used herein, "computer system" may refer to any of a number of components typically found in a computer system including, but not limited to, memory devices such as random access memory (RAM), read-only memory (ROM), Flash memory, permanent memory, volatile memory, removable memory devices, tables and databases.

As used herein, an "RFID tag" refers to a radio frequency identification tag which identifies itself and/or an item with which it is connected. RFID tags are generally passive tags with no power supply or active tags with their own power supply.

As used herein, "embedded" may refer to being positioned on an object or enveloped by an object.

As used herein, an "RFID reader" refers to devices configured to wirelessly communicate with RFID tags. Typical RFID readers transmit a radio frequency signal which does not require line-of-sight with the RFID tag.

In one embodiment, the conveying comprises sliding the container carrier along a track. In one embodiment, the conveying includes transporting the container carrier on a conveyor belt. In another embodiment, the conveying includes transporting the container carrier on a series of powered rollers.

In one embodiment, the sorting the specimen container comprises directing the container carrier (carrying the specimen container) based on a temperature zone requirement for the specimen.

As used herein, "directing" may refer to maintaining or changing a path, removing from a path or positioning in a desired location.

As used herein, "temperature zone" may refer to a set of different temperatures. Temperature zones may be of varying granularity. In a preferred embodiment, temperature zones may include frozen (e.g., about −20° C.), refrigerated (e.g., about 5° C.) and ambient (e.g., about 23° C.). In other embodiments, temperature zones may be divided into finer granularity. For example, temperature zones may be provided for every 5° C. (e.g., −20° C., −15° C., −10° C., etc.).

In one embodiment, the sorting the specimen container comprises directing the container carrier (carrying the specimen container) based on processing to be performed on the specimen. The directing the container carrier may comprise actuating a plunger to direct the container carrier from the path to a corresponding sorted strip.

As used herein, "actuating" may refer to activating, moving or operating.

As used herein, "plunger" may refer to a piston, cylinder, rod or other device configured to move substantially axially when actuated.

As used herein, "sorted strip" refers to a strip with samples that are sorted according to one or more characteristics. In one embodiment, the sorted strip includes specimen containers to be processed at the same lab and/or through the same test.

In one embodiment, the method further comprises physically coupling a container carrier to a specimen container. The physical coupling may be performed either manually or in an automated manner.

As used herein, "physical coupling" refers to physically joining, positioning within, in or on a container carrier.

As used herein, "manually" refers to an action requiring human intervention. In this regard, manually physically coupling may include an operator performing the physical coupling.

As used herein, "automated manner" refers to an action requiring little or no human intervention. In this regard, a robotic system may be used to perform the physical coupling.

In another aspect of the invention, a method comprises binding an identity of a specimen container to an identity of a container carrier carrying the specimen container by associating an identifier of the specimen container with an identifier of the container carrier in a computer system, wherein the identifier of the container carrier is a radio frequency identification (RFID) tag; conveying the container carrier with the specimen container along a path by transporting the container carrier on a conveyor belt; detecting a position of the container carrier on the path by detecting the RFID tag of the container carrier by an RFID reader; and sorting the specimen container based on the detection of the container carrier according to processing to be performed on the specimen by actuating a plunger to direct the container carrier from the path to a corresponding sorted strip.

In another aspect, the invention includes a sorting apparatus comprising a transporter configured to transport a container carrier along a path, the container carrier carrying a specimen container therein; a computer system having an identity of each of the plurality of container carriers bound to an identity of a container carrier, wherein the bound identities are electronically matched; one or more detectors to detect an identity of a container carrier on the transporter; and one or more actuators configured to sort specimen containers by selectively directing each container carrier to a sort strip based on a desired processing of the specimen container contained in the container carrier using the bound identities.

These and other advantages and features of various embodiments of the present invention will become apparent from the following detailed description when taken in conjunction with the accompanying drawings.

BRIEF DESCRIPTION OF THE DRAWINGS

Example embodiments of the invention are described by referring to the attached drawings, in which.

DETAILED DESCRIPTION OF THE INVENTION

Figure 1:
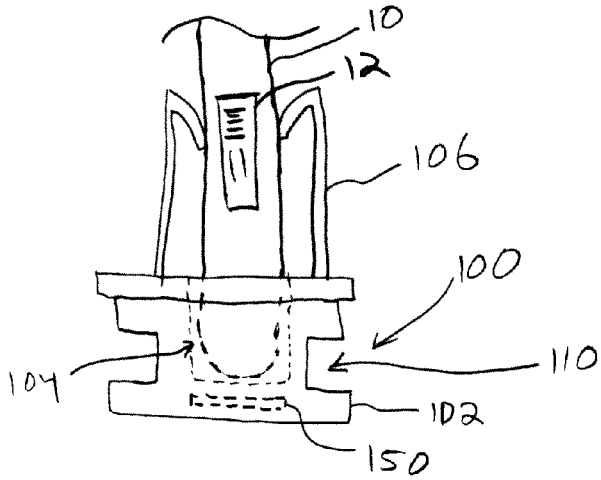
FIG. 1 illustrates an exemplary container carrier with a specimen container contained therein in accordance with an embodiment of the present invention.

In conventional operation, a facility may receive thousands of specimens each day. The samples are first delivered to a plurality of human accessioners, each of which processes an intake of the samples. The accessioners may provide a barcode for each specimen and scan the barcode into a computer system to identify the specimen. The accessioner then enters the test code and/or a lab code into the computer system to indicate the testing or lab requested for the specimen by, for example, a physician.

Once the intake of the specimens is completed by the accessioner, the specimen may be placed in a bin to be taken by another individual for sorting. During the sorting, the plurality of specimens may be manually sorted into various groups, typically in multiple phases. At a first phase, the specimens may be sorted according to a temperature zone in which the specimens must be maintained. Once sorted by temperature zones, the specimens may be taken to a corresponding temperature-controlled environment for further sorting according to, for example, a testing department, followed by sorting according to a corresponding laboratory and followed by sorting according to the test to be performed.

At each sorting step, each of the thousands of specimens must be processed by a human operator. In this regard, the operator may scan the bar code at each station to register the specimen at that station and to indicate sorting into the next stage. Thus, conventional sorting can be labor intensive and, as a result, highly error prone and inefficient.

Robotic sorting systems have been introduced to improve efficiency. However, such robotic systems can be very costly. Further, such robotic systems are limited by spatial restrictions to a low number of sorting categories. For example, a typical facility may require sorting specimens into hundreds, or even thousands, of categories. Since the reach of the robotic arm is limited, the number of categories into which the robotic system can sort the specimens is substantially lower than required.

U.S. Pat. No. 5,150,795 discloses a sorting specimen in which a human operator sorts specimen containers into pre-assigned racks. The racks are then transferred through a conveyor system to appropriate storage sections.

U.S. Pat. No. 4,513,522 discloses a label comprising two semi-rigid cards connected by a connecting member. One card is adhesively affixed to a specimen container, and the other card is adhesively affixed to a pad such as an order slip.

U.S. Pat. No. 7,423,531 discloses an electronic label used to mark a container. The label include a radio identification element intended to be placed inside the container.

U.S. Pat. No. 7,308,114 discloses a method and system providing a transfer container crane with container code recognition of a container identified by a container code to a container inventory management system.

U.S. Pat. No. 4,588,880 discloses information carriers including a memory containing data characterizing the particular workpiece carried thereon.

U.S. Pat. No. 4,974,166 discloses a system for storing, transporting and processing articles. A plurality of transportable containers have an interior region adapted to receive a plurality of articles. A data processing device is provided on the transportable container for receiving, storing, transmitting and displaying information related to the articles received by the transportable container.

U.S. Pat. No. 5,097,421 discloses transportable containers for carrying articles. The transportable containers include a memory used to store the identity, status and history of the articles in the container.

The present invention relates to methods and apparatuses for efficient sorting of specimens. In accordance with embodiments of the present invention, specimen containers, such as vials, are positioned in container carriers, such as pucks. The specimen containers contain a specimen that is to be processed through, for example, one or more tests. The container carriers include an identifier, such as a radio frequency identification (RFID) tag. The container carriers with the specimen containers are then sorted based on the identifier of the container carrier according to the desired processing of the specimen containers.

In accordance with embodiments of the present invention, specimens are received at a facility by one or more accessioners. The specimens may be received in a variety of specimen containers, which may be any container capable of holding a specimen therein. In various embodiments, a specimen container may include a vial, a test tube or other such container.

As noted above, the specimen containers include a specimen (or specimen) therein. The specimen may include any, biological or chemical entity. For example, a specimen may include a biological fluid, such as blood or urine, or a biological tissue sample.

During intake of the specimens by the accessioners, each specimen container is physically coupled to a container carrier by, for example, positioning the specimen container within, in or on a container carrier. In other embodiments, the specimen containers may be received by the facility already positioned within a container carrier. In this regard, a container carrier with a standardized shape and/or size may be used. Further, the physical coupling of the specimen container to the container carrier may be manually performed by an operator or in an automated manner using, for example, a robotic system.

Referring now to FIG. 1, an exemplary container carrier with a specimen container contained therein in accordance with an embodiment of the present invention is illustrated. In the illustrated embodiment of FIG. 1, the container carrier is a puck 100 having a body 102. In various embodiments, the puck may be sized for various configurations. In a preferred embodiment, the puck 100 has a circular base with a diameter of between 0.5 and 1.0 inches, most preferably a diameter of 0.75 inches.

As illustrated in FIG. 1, the puck 100 includes a hollow cavity 104 with an opening on the top surface of the puck 100. The opening and the cavity 104 are configured to receive a specimen container therein, such as the specimen container 10. The specimen container 10 is secured within the cavity 104 with assistance from a plurality of resilient fingers 106 extending upward from the body 102. In one embodiment, the puck 100 includes three resilient fingers 106 positioned evenly around the cavity 104 so as to secure the specimen container from three sides. In other embodiments, additional resilient fingers may be provided.

In the illustrated embodiment of FIG. 1, the puck 100 is provided with a slot 110 around the perimeter of the body 102. As will be described below, the slot 110 facilitates directing of the puck to the appropriate location during the sorting process.

Thus, in accordance with embodiments of the present invention, each puck 100 has a single specimen container positioned therein. In conjunction with positioning the specimen container 10 in the puck 100, binding of the identities of the specimen container 10 and the puck 100 is performed. In this regard, the specimen container 10 and the puck 100 in which the specimen container 10 is positioned are linked or otherwise associated with each other. As an example, in a computer system, an identifier of the specimen container 10, such as a barcode 12, is electronically associated with an identifier of the puck 100, such as a radio frequency identification (RFID) tag 150. Thus, the identity of each specimen container 10 is electronically matched with the identity of a puck 100 in a one-to-one relationship. In this regard, the identity of each puck 100 is associated with a single specimen container 10, and the identity of each specimen container 10 is associated with a single puck 100.

RFID technology is well known to those skilled in the art. As is well known, an RFID tag identifies itself and/or an item with which it is connected, such as the puck 100. RFID tags are generally passive tags with no power supply or active tags with their own power supply. In various embodiments of the present invention, either passive or active RFID tags may be implemented.

The binding of the identities of the specimen container 10 and the puck 100 may be achieved in a variety of manners. In one embodiment, the binding is performed by the accessioner who positions the specimen container 10 in the puck 100. This may be achieved by the accessioner by scanning the barcode of the specimen container 10 and entering or otherwise inputting into a computer system the RFID tag identifier of the puck 100 as associated with the barcode.

In another embodiment, the binding may be performed at a binding station at a later time. In this regard, after the accessioner positions the specimen container 10 in the puck 100, the puck 100 and the specimen container may be sent to a station with an RFID reader and a barcode reader. Upon reading the RFID tag 150 of the puck 100 and the barcode 12 of the specimen container 10, the binding may be performed in a computer system.

The puck 100 may be formed in a variety of manners. In one embodiment, the body 102 of the puck 100 is formed in an injection molding process. The resilient fingers 106 may be formed of a thin metal and may be inserted into slots formed in the body 102 during the injection molding process.

In another embodiment, the puck 100 is formed in a single injection molding process. In this regard, the body 102 and the resilient fingers 106 may both be formed of plastic and may be integrally formed during a single injection molding process.

The RFID tag 150 may be embedded within the body 102 of the puck 100. In other embodiments, the injection molding process may form an opening and a door at the bottom of the body 102, and the RFID tag 150 may be inserted or removed from the opening through the door. The RFID tag 150 also may be located on the outer surface of the puck 100.

After binding of the identities of the puck 100 and the specimen container 10, the RFID tag 150 of the puck 100 allows for precise tracking of the specimen container 10. The puck 100 and the specimen container 10 may then be transported to a sorting station. In this regard, the transport mechanism may be varied based on the layout of the facility between the accessioner and the sorting apparatus as described below.

Figure 2:
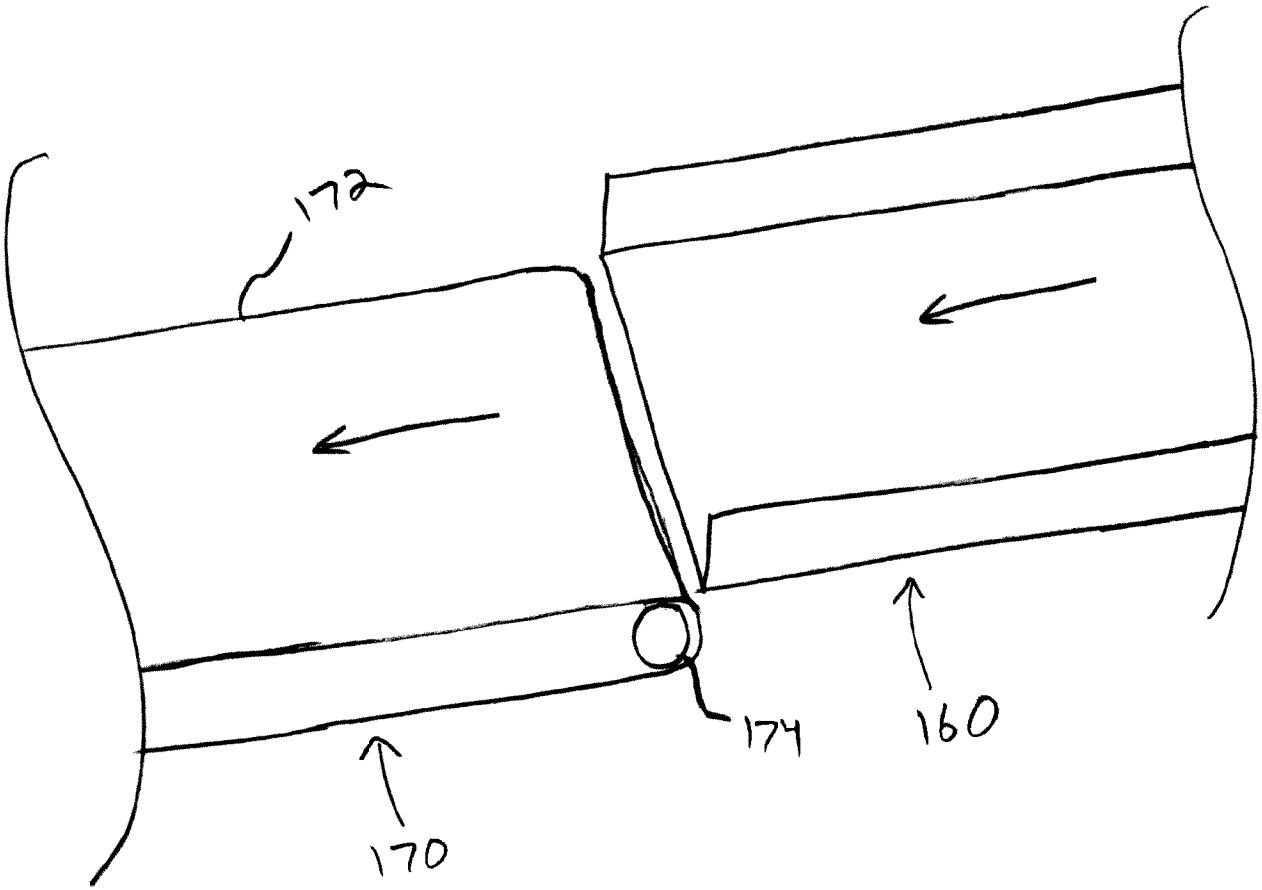
FIG. 2 illustrates an exemplary transporter arrangement in accordance with an embodiment of the present invention.

FIG. 2 illustrates one exemplary transporter arrangement in accordance with an embodiment of the present invention. In accordance with the embodiment illustrated in FIG. 2, the transport system may include a track 160 on which the puck 100 carrying the specimen container 10 may slide. In this regard, the track 160 may be configured such that the puck slides downward, thereby utilizing gravity to transport the puck 100. In some embodiments, the track 160 may be a smooth surface which allows for low-friction sliding of the puck 100. In other embodiments, the track 160 may include rollers which facilitate the downward movement of the puck 100. Such rollers and tracks are well known to those skilled in the art.

The track 160 may guide the puck 100 to the sorting apparatus by transferring the puck 100 to a conveyor belt system 170. The conveyor belt system 170 includes a conveyor belt 172 with one or more rollers 174 that are powered by a motor (not shown). In other embodiments, the conveyor belt system 170 may be replaced with a series of powered rollers.

Figure 3A:
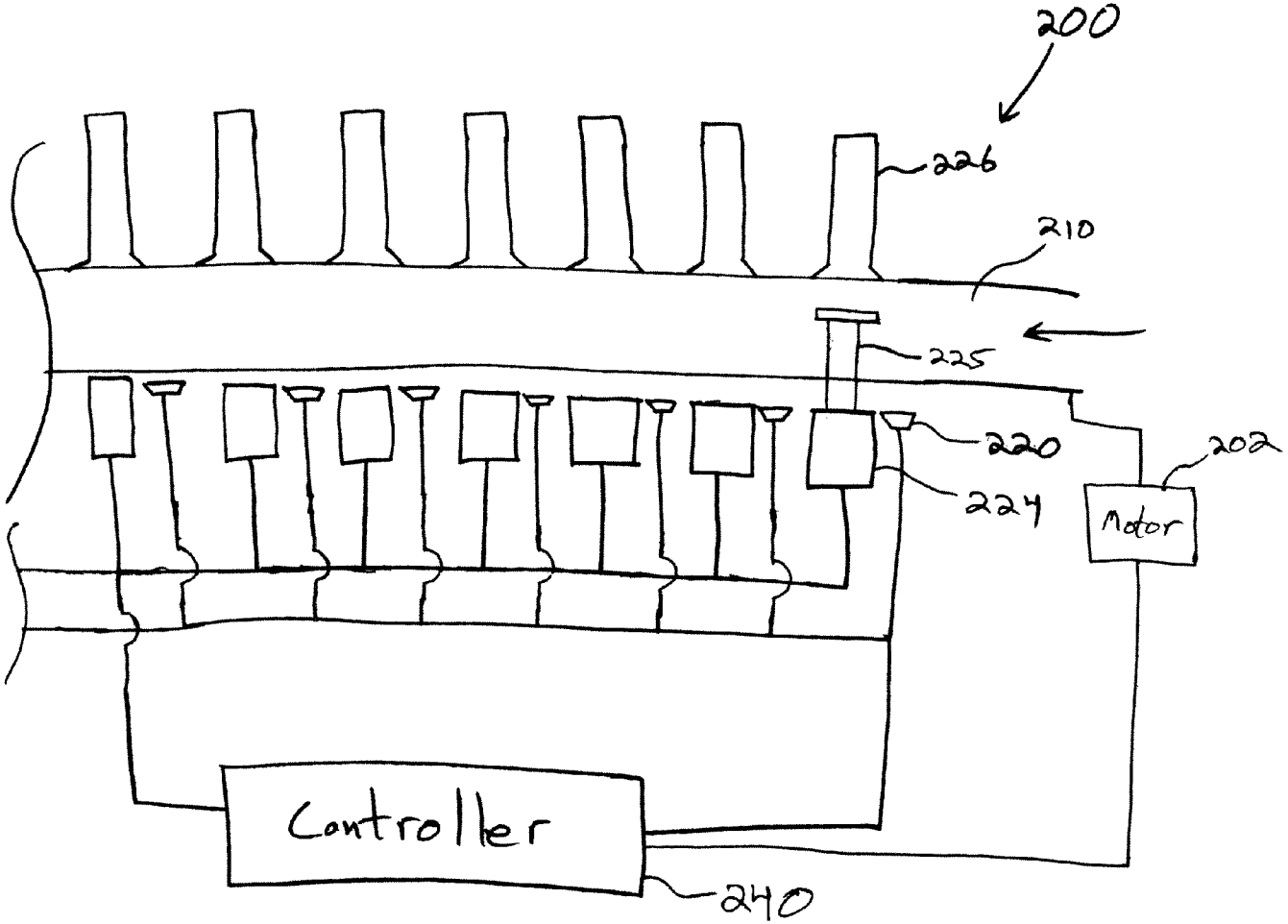
FIG. 3A is a schematic illustration of a sorting apparatus in accordance with one embodiment of the present invention.
Figure 3B:
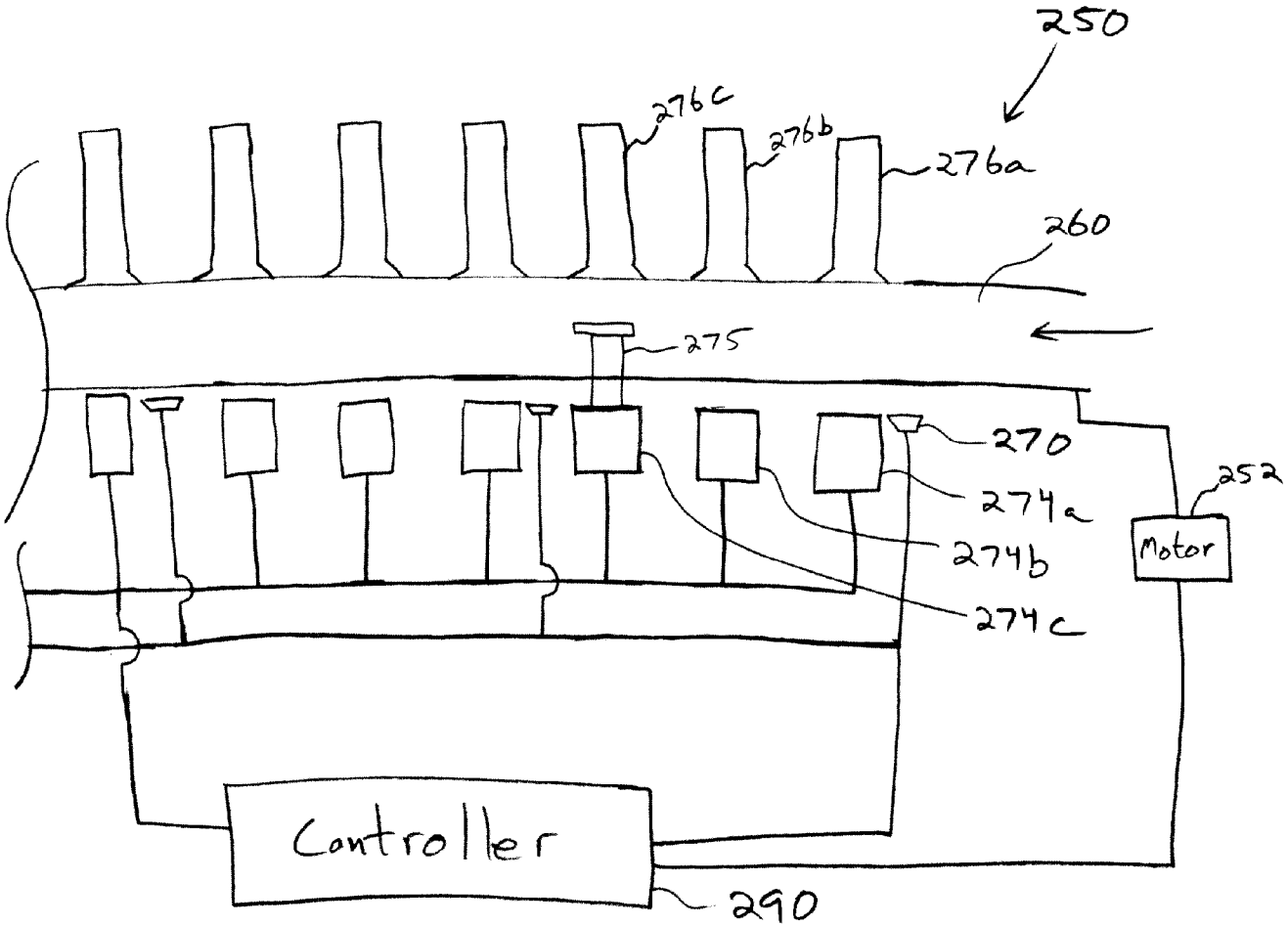
FIG. 3B is a schematic illustration of a sorting apparatus in accordance with another embodiment of the present invention.

Referring now to FIGS. 3A and 3B, sorting apparatuses in accordance with embodiments of the present invention are illustrated. Referring first to FIG. 3A, a sorting apparatus includes a transporter, such as a conveyor belt 210, configured to transport pucks, each carrying a specimen container. The conveyor belt 210 is powered by a motor 202. Preferably, the motor 202 is a variable motor with adjustable output, thereby allowing variability in the speed of the conveyor belt.

One side of the conveyor belt 210 is lined with a series of detectors, such as the RFID reader 220. The RFID readers 220 are configured to detect an identity of a puck on the conveyor belt 210 as it passes by or near the RFID reader 220. Each RFID reader 220 is associated with an actuator, such as a piston pusher mechanism 224. The pusher mechanism 224 is provided with a piston 225 that is configured to push a puck with a specimen container off the conveyor belt 210 and onto a sorted strip, slide or tray 226 on the opposing side of the conveyor belt. Thus, in the embodiment illustrated in FIG. 3A, each RFID reader 220 has a corresponding pusher mechanism 224 and a sorted strip 226. In various embodiments, each sorted strip 226 corresponds to a particular test code or lab code through which specimens are to be processed.

The sorting apparatus 200 is provided with a controller 240 configured to control operation of the apparatus 200. The controller 240 may be a central processing unit (CPU) with a memory device and a variety of additional components, such as a monitor. In a particular embodiment, the controller 240 is configured to communicate, either through wired communication or wireless communication, with a computer system containing information related to the binding of various pucks with corresponding specimen containers. In other embodiments, the controller 240 is a component of the computer system. The controller 240 is also configured to operate the motor 202 of the conveyor belt 210.

Thus, in operation, when a puck is transported on the conveyor belt 210, the various RFID readers 220 can detect the identity of the RFID tag of the puck. The detected information is conveyed to the controller 240, which determines the identity of the puck and the identity of the specimen container bound to the identified puck. This allows the controller 240 to also determine the test code or lab code associated with the specimen. Accordingly, the controller 240 may determine to which sorted strip 226 the puck associated with the detected RFID tag belongs. The controller 240 accordingly issues a command to actuate the appropriate pusher mechanism 224 to direct the puck onto the sorted strip 226. Thus, in the illustrated example, when the RFID reader 220 detects the identity of the RFID tag passing it and sends that information to the controller, it receives a signal indicating whether or not the pusher mechanism 224 associated with the RFID reader 220 should be actuated.

In one embodiment, the conveyor belt has a width of between 1.0 and 2 inches and is 30-40 feet in length. In a particular embodiment, the conveyor belt is about 1.5 inches wide and has a length of about 35 feet. As used herein, "about" means plus or minus 5%, The pusher mechanisms are positioned about two inches apart, each opposite a sorted strip. Thus, a conveyor belt of only about 35 feet may allow sorting in up to about 200 different test codes.

The speed of the conveyor belt may be adjusted to accommodate the precision of the actuation timing of the pusher mechanisms. In one embodiment, the pusher mechanisms cycle through a single actuation in approximately 2 milliseconds. The distance between the reader and the first actuator following the reader also may be optimized to accommodate the precision of the actuation timing of the pusher mechanism of that first actuator.

While the embodiment of FIG. 3A illustrates each RFID reader 220 associated with a single pusher mechanism 224 and a single sorted strip 226, other embodiments may have fewer RFID readers. For example, as illustrated in FIG. 3B, a sorting apparatus 250 with a conveyor belt 260, a motor 252, and a controller 290 may have three pusher mechanisms 274*a-c* and three sorted strips 276*a-c* associated with a single RFID reader 270. In this regard, upon detection of the RFID tag by the RFID reader 270, the controller may determine that the puck is to be directed to the third sorted strip 274*c*. Based on the speed of the conveyor belt 260, the controller 290 can calculate when to actuate the third pusher mechanism 274*c* in order to direct the puck onto the third sorted strip 276*c*. In still other embodiments, other sensors may be provided to detect the position of the identified RFID tag. Thus, sensors may be used to determine when to actuate the pusher mechanism 274*c*.

While FIG. 3B illustrates three sorted strips for each RFID reader, in other embodiments, any practical number of strips may be provided for each RFID reader. In one preferred embodiment, an RFID reader may be provided for every 10-15 sorted strips.

Figure 4B:
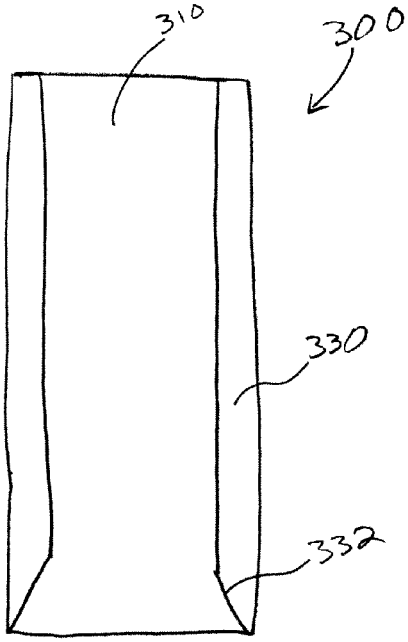
FIGS. 4A-C illustrate various views of a sorted strip in accordance with an embodiment of the present invention.
Figure 4A:
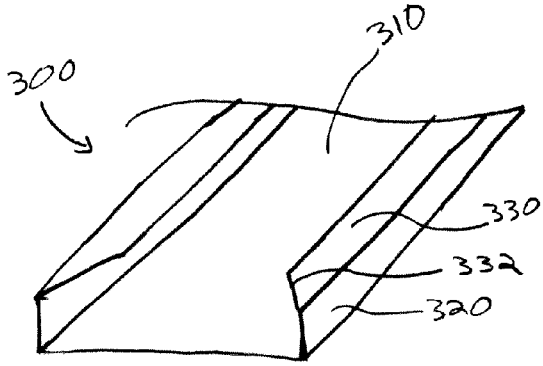
Figure 4C:
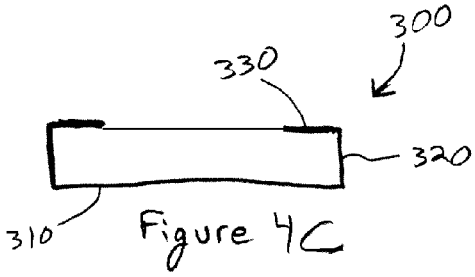

Referring now to FIGS. 4A-C various views of an exemplary sorted strip in accordance with an embodiment of the present invention are illustrated. The exemplary sorted strip 300 is provided with a flat bottom surface 310 and side walls 320 sized to accommodate a puck, such as the puck illustrated in FIG. 1. On the top ends of the side walls 320, the sorted strip 300 is provided with guides 330 configured to slide into the slot 110 of the puck 100 (FIG. 1). The guides 330 have tapered front ends 332 to form a funnel shape which facilitates the insertion of the pucks into the strips 300. Thus, when a pusher mechanism directs a puck off the conveyor belt and onto a strip, certain amount of positioning error can be accommodated.

The sorted strips 300 may be sized to accommodate any number of pucks. In a preferred embodiment, each sorted strip 300 accommodates twelve pucks. Further, the sorted strips 300 are preferably removable from the sorting apparatus. In this regard, once a sorted strip is full, a complete set of twelve pucks may be removed and carried to a testing apparatus, such as a pipetting machine, for example. Thus, in one embodiment, the pucks and the sorted strips may be configured for interoperability with the sorting apparatus and various testing machines.

In various embodiments, the sorting apparatus may include multiple enclosed or partially enclosed layers of conveyor belts. In this regard, each layer may correspond to a certain temperature zone. For example, a top layer conveyor belt may correspond to an ambient zone, a middle layer may correspond to a refrigerated zone, and a bottom layer may correspond to a frozen zone. An ambient zone conveyer need not be enclosed. Of course, any practical number of layers may be provided.

Thus, embodiments of the present invention provide for efficient sorting of specimens in a cost-effective manner. Other than the above-described role of accessioners, human processing can be eliminated. The accessioners merely perform intake of the specimen containers into the facility and place them in any available puck. Sorting by humans can be completely eliminated.

Further, in accordance with embodiments of the present invention, sorting can be performed on a continuous basis. Since accessioners can place individual specimen containers into a puck and onto the sorting system, there is no delay time in filling up a tray or a bin before sorting can be started.

Still further, systems in accordance with embodiments of the present invention can be built or assembled in a cost-effective manner and with high reliability.

Further, the space requirements are substantially reduced. A large number of sorted categories (e.g., test codes) can be accommodated in a relatively small area. Unlike existing robotic systems, there is no limitation on the number of sort categories imposed by the space available. Further, systems according to embodiments of the invention are readily scalable to accommodate even greater number of sorted categories.

Unless otherwise defined, all technical and scientific terms used herein have the same meaning as commonly understood by one of ordinary skill in the art to which this invention belongs.

The inventions illustratively described herein may suitably be practiced in the absence of any element or elements, limitation or limitations, not specifically disclosed herein. Thus, for example, the terms "comprising", "including," containing", etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the invention claimed.

Thus, it should be understood that although the present invention has been specifically disclosed by preferred embodiments and optional features, modification, improvement and variation of the inventions embodied therein herein disclosed may be resorted to by those skilled in the art, and that such modifications, improvements and variations are considered to be within the scope of this invention. The materials, methods, and examples provided here are representative of preferred embodiments, are exemplary, and are not intended as limitations on the scope of the invention.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

In addition, where features or aspects of the invention are described in terms of Markush groups, those skilled in the art will recognize that the invention is also thereby described in terms of any individual member or subgroup of members of the Markush group.

All publications, patent applications, patents, and other references mentioned herein are expressly incorporated by reference in their entirety, to the same extent as if each were incorporated by reference individually. In case of conflict, the present specification, including definitions, will control.

Other embodiments are set forth within the following claims.

What is claimed is:

1. A method, comprising:

binding an identity of a specimen container to an identity of a container carrier carrying the specimen container, wherein an identity of each container carrier is bound to an identity of an individual specimen container in a one-to-one relationship;

conveying the container carrier with the specimen container along a path;

detecting a position of the container carrier on the path; and sorting the specimen container based on the detection of the container carrier using the bound identities.

2. The method of claim 1, wherein the binding electronically matches the identity of the specimen container and the identity of the container carrier.

3. The method of claim 1, wherein a plurality of specimen containers are conveyed and sorted.

4. The method of claim 1, wherein the specimen container includes a specimen therein for processing.

5. The method of claim 4, wherein the specimen is a biological fluid or a biological tissue.

6. The method of claim 4, wherein the processing comprises performing one or more tests on the specimen.

7. The method of claim 1, wherein the binding comprises:

associating an identifier of the specimen container with an identifier of the container carrier in a computer system.

8. The method of claim 7, wherein the identifier of the specimen container comprises a bar code.

9. The method of claim 7, wherein the identifier of the container carrier comprises a radio frequency identification (RFID) tag.

10. The method of claim 9, wherein the RFID tag is attached to a body of the container carrier.

11. The method of claim 9, wherein the detecting a position of the container carrier includes detecting the RFID tag of the container carrier by an RFID reader.

12. The method of claim 1, wherein the conveying comprises:

sliding the container carrier along a track.

13. The method of claim 12, wherein the conveying further comprises:

transporting the container carrier on a conveyor belt.

14. The method of claim 1, wherein the conveying comprises:

transporting the container carrier on a conveyor belt.

15. The method of claim 1, wherein the conveying comprises:

transporting the container carrier on a series of powered rollers.

16. The method of claim 1, wherein the sorting the specimen container comprises:

directing the container carrier based on a temperature zone requirement for the specimen.

17. The method of claim 16, wherein the sorting the specimen container further comprises:

directing the container carrier based on processing to be performed on the specimen.

18. The method of claim 1, wherein the sorting the specimen container comprises:

directing the container carrier based on processing to be performed on the specimen.

19. The method of claim 18, wherein the directing the container carrier comprises:

actuating a plunger to direct the container carrier from the path to a sorted strip.

20. The method of claim 1, further comprising:

physically coupling a container carrier to a specimen container.

21. The method of claim 20, wherein the physically coupling is performed manually.

22. The method of claim 20, wherein the physically coupling is performed in an automated manner.

23. A method, comprising:

binding an identity of a specimen container to an identity of a container carrier carrying the specimen container by associating an identifier of the specimen container with an identifier of the container carrier in a computer system, wherein the identifier of the container carrier is a radio frequency identification (RFID) tag, wherein an identity of each container carrier is bound to an identity of an individual specimen container in a one-to-one relationship;

conveying the container carrier with the specimen container along a path by transporting the container carrier on a conveyor belt;

detecting a position of the container carrier on the path by detecting the RFID tag of the container carrier by an RFID reader; and sorting the specimen container based on the detection of the container carrier according to processing to be performed on the specimen by actuating a plunger to direct the container carrier from the path to a corresponding sorted strip.

24. The method of claim 23, wherein a plurality of specimen containers are conveyed and sorted.

25. The method of claim 23, further comprising:

physically coupling a container carrier to a specimen container.

* * * * *

UNITED STATES PATENT AND TRADEMARK OFFICE

CERTIFICATE OF CORRECTION

PATENT NO. : 8,459,462 B2
APPLICATION NO. : 12/249819
DATED : June 11, 2013
INVENTOR(S) : Leroy Sina Lavi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 956 days.

Signed and Sealed this
Ninth Day of December, 2014

Michelle K. Lee

Michelle K. Lee
*Deputy Director of the United States Patent and Trademark Office*